US005893324A

United States Patent [19]

Kimura

[11] Patent Number: 5,893,324

[45] Date of Patent: Apr. 13, 1999

[54] STENCIL FORMING APPARATUS

[75] Inventor: Kaoru Kimura, Ibaraki, Japan

[73] Assignee: Riso Kagaku Corporation, Tokyo, Japan

[21] Appl. No.: 08/961,418

[22] Filed: Oct. 30, 1997

[30] Foreign Application Priority Data

Oct. 30, 1996 [JP] Japan ..... 8-288532

[51] Int. Cl.[6] ..... B41L 13/14

[52] U.S. Cl. ..... 101/117; 101/128.4

[58] Field of Search ..... 101/117, 128.4, 101/116, 118, 121, 129, 127; 427/143; 430/308; 400/120.01

[56] References Cited

U.S. PATENT DOCUMENTS

| | | | |
|---|---|---|---|
| 3,889,595 | 6/1975 | Jaffa | 101/116 |
| 4,051,776 | 10/1977 | Zimmer | 101/118 |
| 4,628,813 | 12/1986 | Hasegawa et al. | 101/116 |
| 5,033,373 | 7/1991 | Brendel et al. | 100/38 |
| 5,164,744 | 11/1992 | Yoshida et al. | 346/76 PH |
| 5,450,789 | 9/1995 | Hasegawa | 101/129 |

FOREIGN PATENT DOCUMENTS

| | | | |
|---|---|---|---|
| 0 707 976 | 4/1996 | European Pat. Off. | B41L 13/06 |

*Primary Examiner*—Edgar Burr
*Assistant Examiner*—Dave A. Ghatt
*Attorney, Agent, or Firm*—Sughrue, Mion, Zinn, Macpeak & Seas, PLLC

[57] ABSTRACT

A stencil forming apparatus in which a stencil for a stencil printing formed from a rolled stencil sheet, includes: a guide roller; a rotatable platen roller having a central axis which is in parallel with the guide roller; a thermal head having a plurality of heat generating elements, and provided above the platen roller, wherein the stencil sheet pulled out of the rolled stencil sheet is passed through the platen roller and the thermal head through the guide roller and is subjected to thermally making fine holes thereon (the stencil of the stencil printing); and an intermediate roller provided between the platen roller and the guide roller wherein the intermediate roller is vertically movable in a predetermined range.

5 Claims, 6 Drawing Sheets

STENCIL FORMING APPARATUS

BACKGROUND OF THE INVENTION

This invention relates to a stencil forming apparatus which make minute holes on a stencil pulled out from a rolled stencil sheet.

FIG. 7 shows a conventional stencil forming apparatus. A stencil printing sheet S for the stencil printing (hereinafter referred to merely as "a stencil sheet S") which is in the form of a roll is held by a master holder 106. A stencil sheet S pulled out of a rolled stencil sheet S is in the form of a belt. The stencil sheet S is laid over a set guide shaft 100 to change the direction of its movement, and inserted between a thermal printing head (TPH) 101 and a platen roller 102, and then laid over a winding roller 103. Furthermore the stencil sheet S is inserted between an upper load roller 104 and a lower load roller 105, thus being conveyed to an initial stop position.

In order that, when the stencil sheet S is conveyed, the part of the sheet which is held between the thermal head 101 and the platen roller 102 may not be creased, a back tension unit 107 of the master holder 106 applies tension to the stencil sheet S in the direction which is opposite to the direction of conveyance of the stencil sheet S.

When the thermal head 101 thermally makes fine holes on the stencil sheet S, the power of conveying the stencil sheet S is provided by the platen roller 102 only which holds the stencil sheet S with the thermal head 101. The stencil sheet S thus formed is moved downwardly into a holding box 108 by means of the winding roller 103. Until the thermal cutting of the stencil sheet S is accomplished by the thermal head 101, the stencil sheet S thus cut is temporarily held (stored) in the holding box 108.

After the stencil sheet S has been formed with the thermal head 101, the latter 101 is moved upwardly to release the stencil sheet S. The front end portion of the stencil sheet S thus released is conveyed to a clamp board 110 on a printing drum 109 by means of the upper and lower load rollers 104, so that the front end portion of the stencil sheet S is secured to a printing drum 109 with the clamp board 110. As the printing drum 109 turns, the upper and lower load rollers 104 and 105 are turned to convey the stencil sheet S so that the sheet S is wound on the printing drum. Thereafter, the stencil sheet S is cut off with a cutter unit 111.

The above-described stencil forming apparatus serves also as a stencil printing machine. Part of the structure of the stencil printing machine is shown in the drawings. A part of the cylindrical wall of the printing drum 109 is ink-permeable. An ink supplying means for supplying ink to the inner surface of the printing drum 109 is provided inside the drum 109. A pressing means, namely, a press roller is provided below the printing drum to press a printing sheet against the printing drum 109. The printing drum 109 is turned, while a printing sheet is fed into the space between the printing drum 109 and the pressing means, so that the printing sheet is pressed against the image region of the stencil sheet S wound on the printing drum 109. The printing ink supplied from the inner cylindrical surface of the printing drum 109 passes through the cylindrical wall of the printing drum 109, and transfers through the cuts of the stencil sheet S onto the printing sheet to form an image thereon.

The conventional stencil forming apparatus shown in FIG. 7 suffers from the following difficulties: Because the set guide shaft 100 and the platen roller 102 are not in parallel with each other, the stencil sheet S being conveyed is liable to slacken, and, when the stencil sheet S is cut, it is liable to be creased.

SUMMARY OF THE INVENTION

In view of the foregoing, an object of the invention is to provide a stencil forming apparatus in which, in the formation of a printing stencil, the stencil sheet S is not creased.

The present invention provides a stencil forming apparatus in which a stencil for a stencil printing formed from a rolled stencil sheet, the stencil forming apparatus comprising: a guide roller; a rotatable platen roller having a central axis which is in parallel with said guide roller; a thermal head having a plurality of heat generating elements, and provided above the platen roller, wherein the stencil sheet pulled out of the rolled stencil sheet is passed through the platen roller and the thermal head through the guide roller and is subjected to thermally making fine holes thereon (the stencil of the stencil printing); and an intermediate roller provided between the platen roller and the guide roller wherein the intermediate roller is vertically movable in a predetermined range.

Furthermore, in the stencil forming apparatus described above, the intermediate roller is arranged between the platen roller and the guide roller such that the intermediate roller is closer to the platen roller.

Still further, in the stencil forming apparatus described above, between the platen roller and the guide roller, the intermediate roller is brought into contact with the surface of the stencil sheet which is in contact with the thermal head.

DETAILED DESCRIPTION OF THE PREFERRED EMBODIMENTS

A stencil forming apparatus, which constitutes a preferred embodiment of the invention, will be described with reference to FIGS. 1 through 6.

Figure 1:
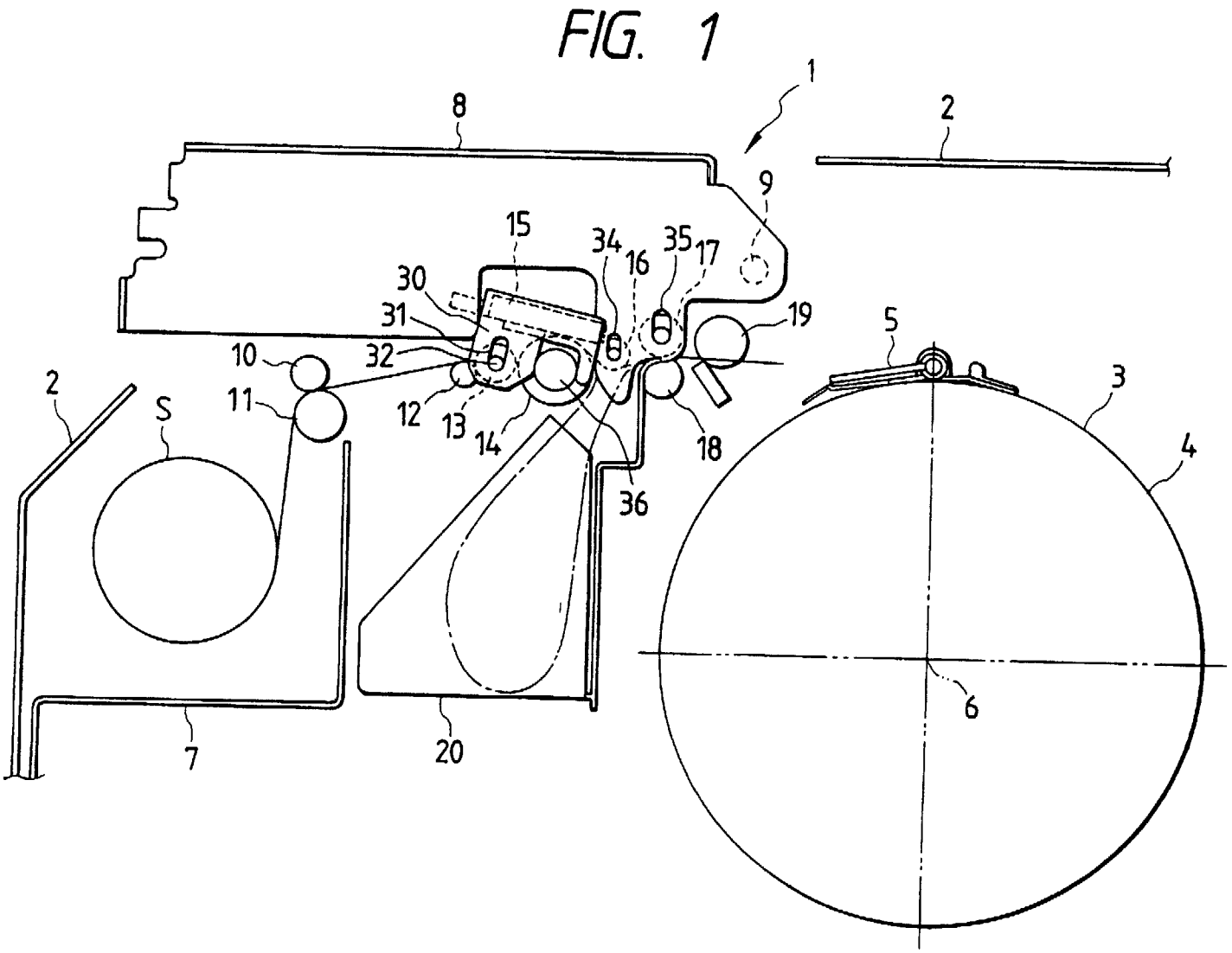
FIG. 1 is a sectional view showing a stencil forming apparatus, which constitutes an embodiment of the invention.

In those figures, reference numeral 1 designates the stencil forming apparatus. The stencil forming apparatus 1 has a stencil forming function of thermally forming a stencil sheet S with a thermal head, and a printing function of printing an image on a printing sheet through the stencil sheet S. As shown in FIG. 1, a printing drum 3 is provided inside a body frame 2. The printing drum 3 includes: a cylindrical wall 4 at least a part of which is ink-permeable; a fixing means, namely, a clamp board 5 which is provided on the outer cylindrical surface of the cylindrical wall 4; and an ink supplying means (not shown) which is provided inside the cylindrical wall 4 to supply ink to the inner cylindrical surface of the cylindrical wall 4. The printing drum 3 is driven to rotate around its own rotary shaft 6 set at a predetermined position. Below the printing drum 3, a pressing means, namely, a press roller (not shown) is provided to press a printing sheet against the printing drum 3.

A master holder 7 is provided inside a body frame 1, which accommodates a roll of stencil sheet S in such a manner that the roll is rotatable. The stencil sheet S is obtained by bonding a porous support member to a heat-sensitive film. In the stencil forming apparatus, the upper surface of the body frame 2 is partially opened. In this open part, a stencil pressing frame is swingably provided with the aid of a supporting shaft 9. Between the master holder 7 and the printing drum 3, a nip roller 10, a tension roller 11, a set guide shaft 12, an intermediate roller 13, a platen roller 14, a thermal head 15 (hereinafter referred to as "a TPH 15", when applicable), a winding roller 16, upper and lower load roller 17 and 18, and a cutter unit 19 in the stated order as viewed from the master holder 7. The stencil sheet S is conveyed passing through those rollers, and is thermally cut with the TPH 15. Inside the body frame 1, a holding (storing) box 20 is provided below the platen roller 14, the TPH 15, and the winding roller 16. The holding box 20 is to temporarily hold the stencil sheet S which has been thermally cut.

Figure 5:
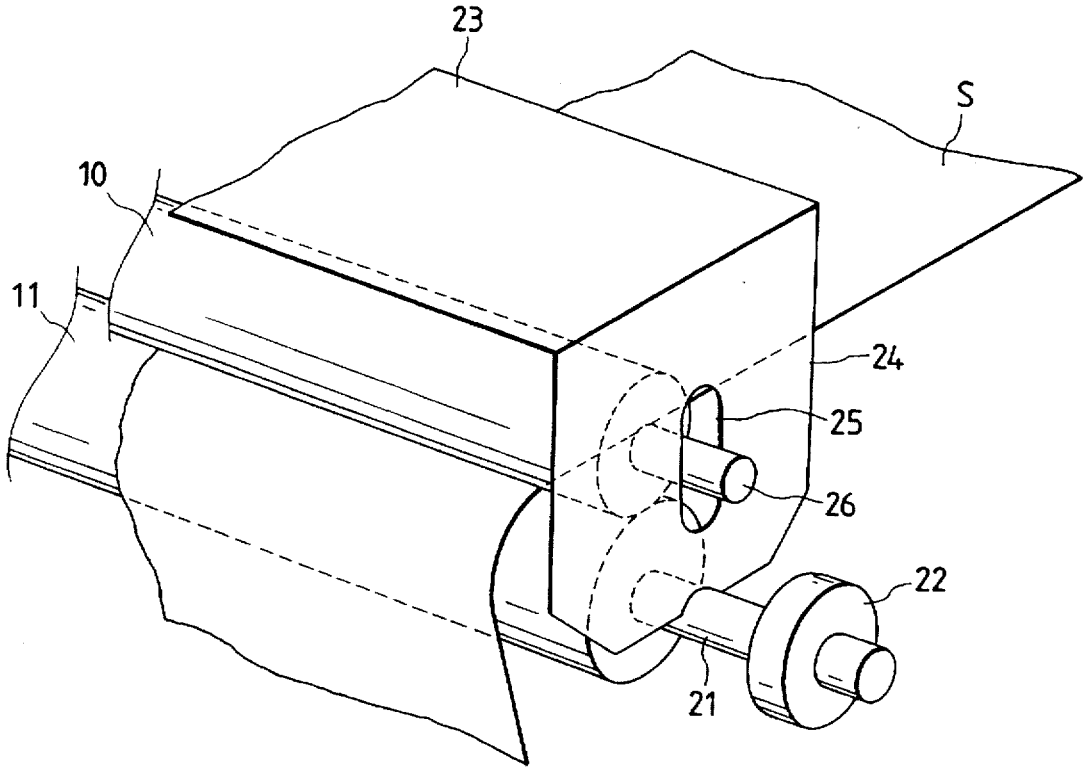
FIG. 5 is a perspective view showing an arrangement of a tension roller and its relevant components in the embodiment of the invention.

The nip roller 10 and the tension roller 11 are mounted on the body frame 2 (however, the nip roller 10 may be mounted on the stencil pressing plate 8). The cylindrical surface of the tension roller 11, as shown in FIG. 5, is made of high-friction material, or surface-treated so as to be high in friction, so that the stencil sheet S scarcely slips. The shaft 21 of the tension roller 11 is rotatably supported at a predetermined position inside the body frame 2. The shaft 21 of the tension roller 11 is provided with a torque limiter 22. Hence, in the conveyance of the stencil sheet S, the tension roller 11 will never idle; that is, a predetermined torque is applied thereto.

As shown in FIG. 5, the nip roller 10 is provided on the tension roller 11. A horizontal supporting board 23 is secured to the body frame 2 (however, the supporting board 23 may be secured to the stencil pressing frame 8). The supporting board 23 has right and left side boards 24 at both ends in such a manner that those boards 24 are extended downwardly. Each of the side boards 24 has a vertically elongated hole 25. Both end portions of the shaft 26 of the nip roller 10 is movably engaged with the elongated holes 25, respectively. Hence, the nip roller 10 is vertically movable along the elongated holes 25. In the embodiment, the nip roller 10 is brought into contact with the tension roller 11 by its own weight.

Figure 6:
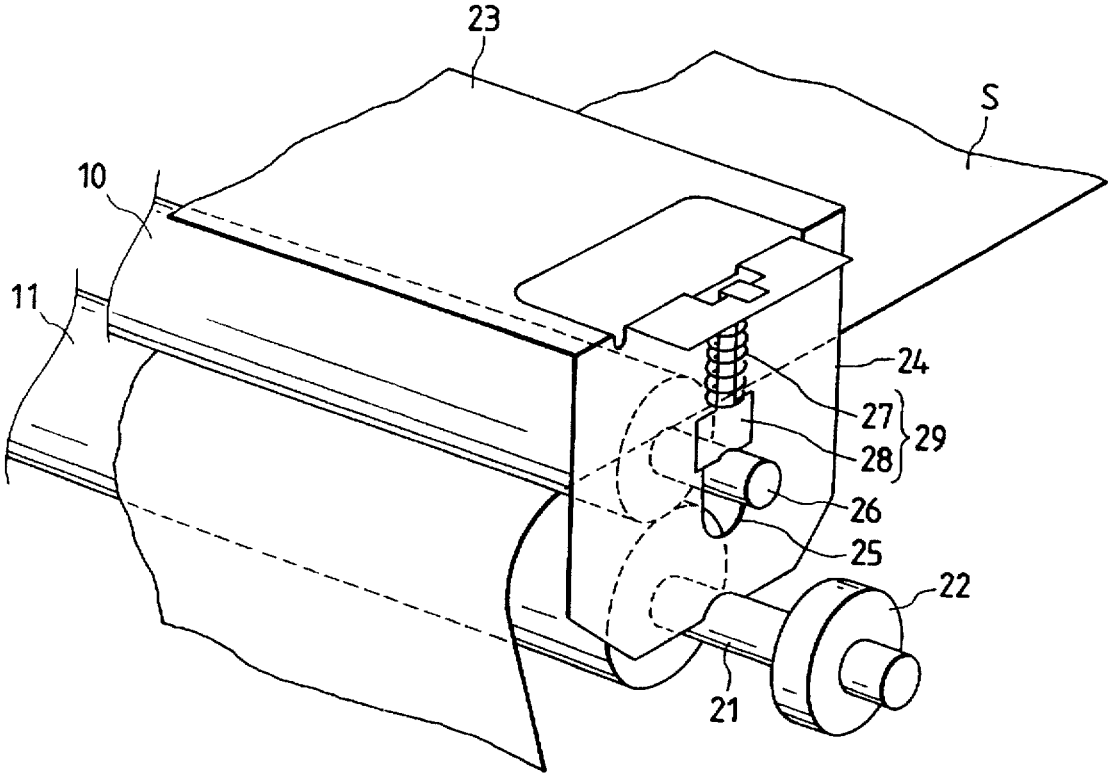
FIG. 6 is a perspective view showing another arrangement of the tension roller and its relevant components in the embodiment of the invention.
Figure 7:
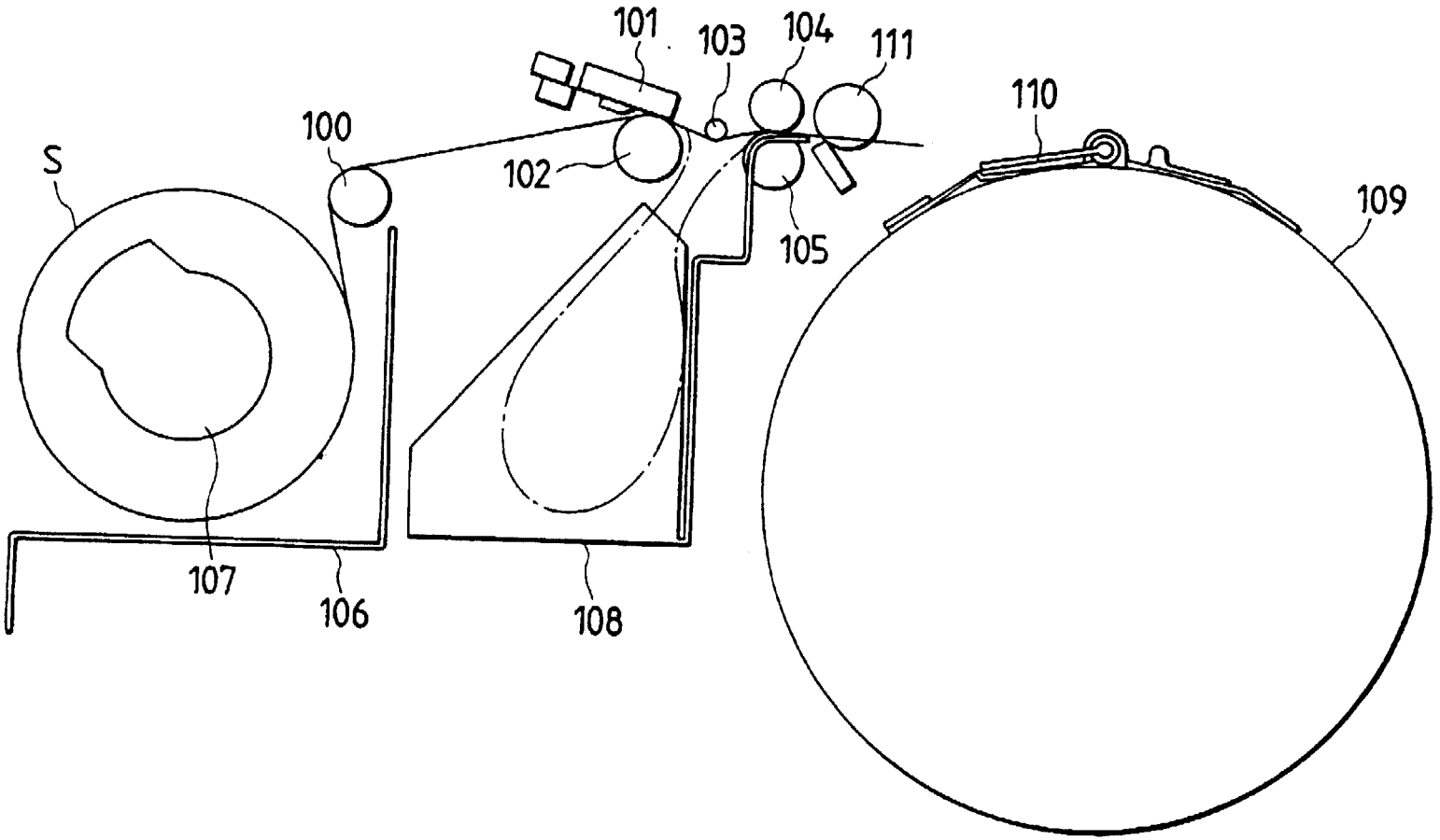
FIG. 7 PRIOR ART
FIG. 7 is a sectional view showing an example of a conventional stencil forming apparatus.

Alternately, as shown in FIG. 6, an urging means 29 comprising a compression spring 27 and a pressing body 28 may be provided on or near each of the side boards 24, to urge the both ends of the shaft 26 of the nip roller 10 downwardly so that the latter 10 is in contact with the tension roller 11.

The torque limiter 22 is mounted on the shaft of the tension roller 11. Hence, the stencil sheet S held between the tension roller 11 and the nip roller is passed through the platen roller 14 and the TPH 15 under the condition that a predetermined tension is applied thereto, irrespective of the diameter of the roll of stencil sheet S in the master holder 7.

Figure 2:
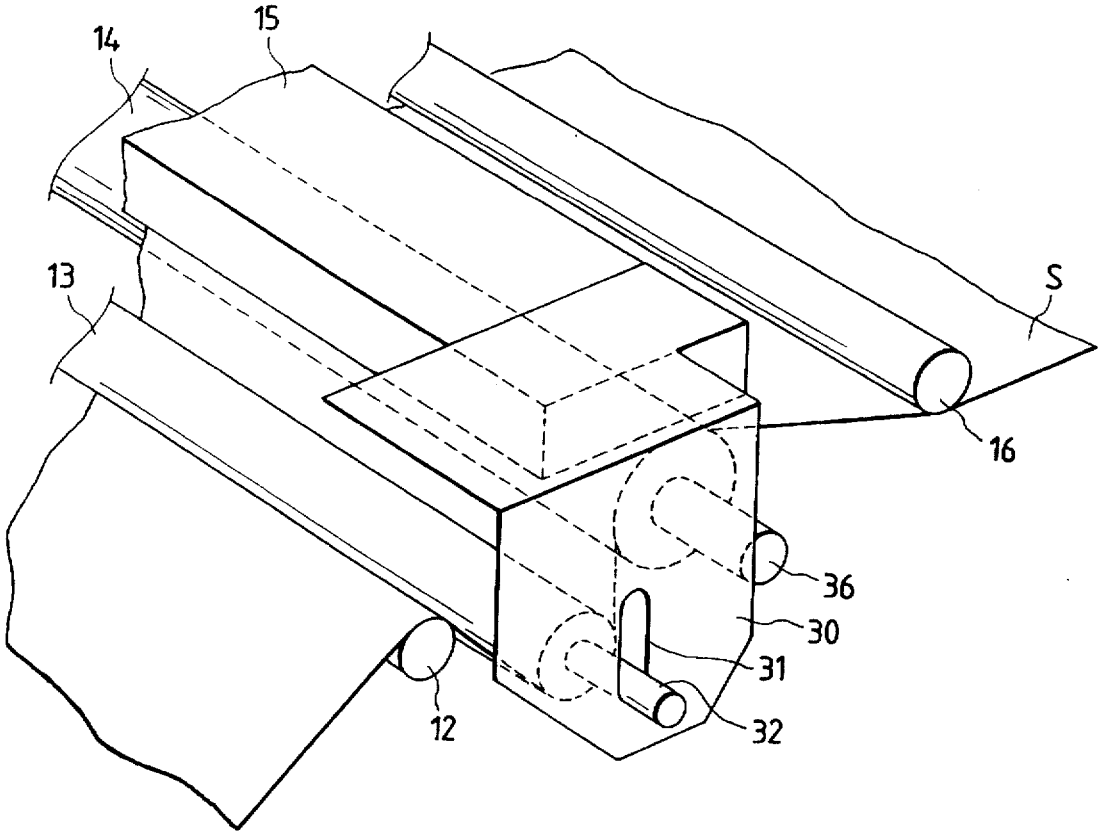
FIGS. 2 and 3 are a perspective view and a side view, respectively, showing an arrangement of a thermal head and its relevant components in the embodiment of the invention.
Figure 3:
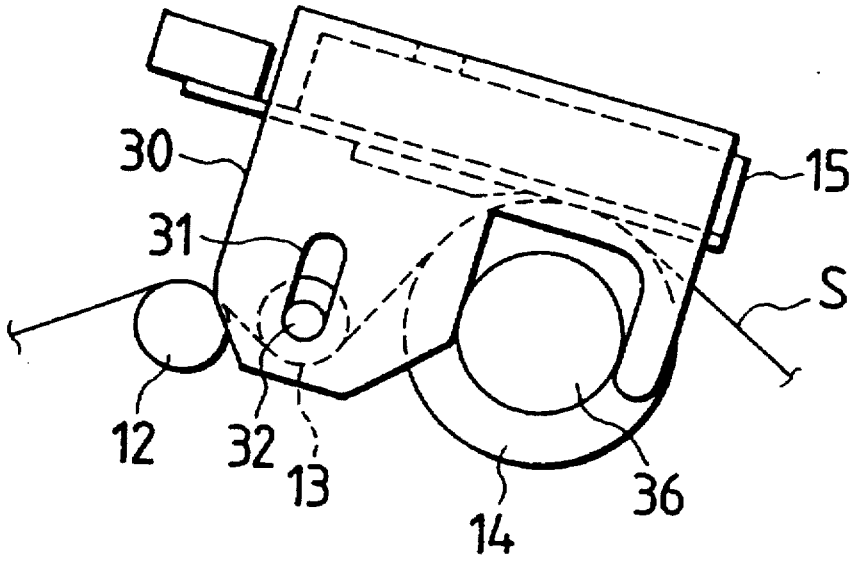

As shown in FIG. 1, the TPH 15 is mounted on the stencil pressing frame 8. As shown in FIGS. 2 and 3, the TPH 15 is elongated-plate-shaped, and it is laid in parallel with the direction of width of the stencil sheet S conveyed and is in contact with the upper surface of the stencil sheet S. The TPH 15 is driven by a drive mechanism (not shown) to move to and from the platen roller 14. More specifically, when the stencil sheet S is subjected to making fine holes, the TPH 15 is brought into contact with the platen roller 14, and after the stencil sheet S has been formed, the TPH 15 is moved away from the platen roller 14 by a TPH lifting mechanism (not shown). The TPH has a plurality of heat generating elements which are arranged in parallel with the direction of width of the stencil sheet S. That is, the stencil sheet S is thermally formed with heat generated thereby.

The platen roller 14 is provided in the body frame 2 located below the TPH 15. When the stencil pressing frame 8 is closed, the TPH 15 provided on the frames 8 is brought into contact with the platen roller 14 mounted on the body frame 2. The stencil sheet S held between the TPH 15 and the platen roller 14, while being conveyed by the roller 14, is subjected to making fine holes by heat generated by the heat generating elements of the TPH 15.

As shown in FIGS. 2 and 3, the TPH 15 has TPH pawls 30 at both ends. As shown in FIG. 1 and 3, the TPH pawls 30 are engaged with the shaft 36 of the platen roller 14, so that the platen roller 14 is positioned with respect to the TPH 15. Each of the TPH pawls 30 has a vertically elongated hole 31, with which both end portions of the shaft 32 of the intermediate roller 13 are movably engaged. The roller 13 is movable vertically along the elongated holes 31. In front of the intermediate shaft 13, a set guide shaft 12 is provided as a stencil sheet guide roller. However, the set guide shaft 12 may be secured to the body frame 2. The intermediate roller 13 serves to sag the stencil sheet platent roller 14, under its own weight.

Figure 4:
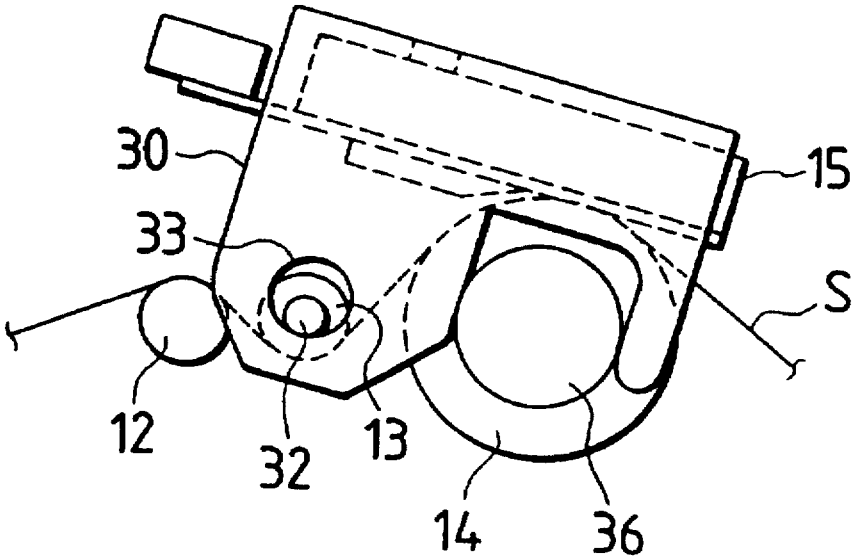
FIG. 4 is a side view showing another arrangement of the thermal head (TPH) and its relevant components in the embodiment of the invention.

As shown in FIG. 4, instead of the elongated holes 31 formed in the TPH pawls 30, round holes 33 may be employed. In this case, the diameter of the round holes 33 is larger than the diameter of the shaft 32 of the intermediate roller 13, and therefore the shaft 32 of the intermediate roller 12 is vertically and horizontally movable in the round holes 33.

As shown in FIG. 1, the winding roller 16 and the upper load roller 17 are vertically movably and rotatably engaged with vertically elongated holes 34 and 35, respectively.

The printing stencil forming operation of the above-described apparatus will be described.

The stencil sheet S is laid over the above-described rollers. First, the stencil pressing frame 8 is opened. A belt-shaped stencil sheet S is pulled out of a roll of stencil sheet S accommodated in the master holder 7. The stencil sheet S thus pulled out is inserted into between the nip roller 10 and the tension roller 11. Thereafter, the stencil sheet S is laid over the set guide shaft 12, the platen roller 14, and the lower load roller 18 (thus being in contact with the upper parts of the cylindrical surfaces of those roller). Under this condition, the stencil pressing frame 8 is closed, to hold the stencil sheet S between the TPH 15 and the platen roller 14.

In forming a stencil, image data are applied to the TPH 15. The TPH 15 forms an image on the stencil sheet S (held between the TPH 15 and the platen roller 14) thermally according to the image data. During thermally forming, the stencil sheet S is conveyed by the drive force of the platen roller 14. The direction of movement of the stencil sheet S thus processed is bent downwardly by the winding roller 16, and led into the holding (storing) box. Until a series of stencil forming operations are accomplished, the stencil sheet S thus formed is accommodated (stored) in the holding box 20.

In the above-described stencil forming operation, the stencil sheet S which is pulled out of the rolled stencil sheet S and conveyed, is held between the tension roller 11 and the nip roller 10, and therefore it is conveyed to the TPH 15 while being tensed to some extent at all times.

The intermediate roller 13 slackens the stencil sheet S by its own weight which is laid over the set guide shaft 12 and the platen roller 14. As was described above, during a stencil forming operation, a certain tension is applied to the stencil sheet S by the nip roller 10 and the tension roller 11, and the intermediate roller 13 is vertically movable and is in contact with the stencil sheet S from above. Hence, during the conveyance of the stencil sheet S, the intermediate roller 13 is raised by the stencil sheet S to which the certain tension is applied, and therefore the shaft 32 of the intermediate roller 13 is raised above the lower ends of the elongated holes 31. Hence, the shaft 32 of the intermediate roller 13 is automatically held in parallel with the central axis of the platen roller 14. Therefore, the stencil sheet S thus conveyed is not slackened, and the stencil sheet S which is subjected to thermally making fine holes is scarcely creased.

After a stencil is formed in the above-described manner, a printing operation is carried out. The TPH 15 is moved upwardly to move away from the platen roller 14. That is, the holding of the stencil sheet S by the TPH 15 and the platen roller 14 is eliminated. The front end of the stencil sheet S on which images have been formed by thermal cutting is sent to the clamp board 5 by the upper and lower load rollers 17 and 18, and the front end of the stencil sheet S is fixed to the printing drum 3 with the clamp board 5. The upper and lower load rollers 17 and 18 rotate to convey the stencil sheet S, while the printing drum 3 rotates, so that the stencil sheet S is wound on the printing drum 3 (a stencil winding operation). Thereafter, the stencil sheet S is cut off with a cutter unit 19, to leave the stencil on the printing drum.

While the printing drum 3 is turned, a printing sheet is fed into the space between the printing drum 3 and the pressing means. As a result, the pressing means presses the printing sheet against the image region of the stencil sheet S (the stencil) wound on the printing drum 3. The printing ink supplied through the inner cylindrical surface of the printing drum 3 passes through the cylindrical wall 4 of the printing drum 3, thus being transferring onto the printing sheet through the thermally process region of the stencil sheet S. Thus, the stencil image is formed on the printing sheet.

In the stencil forming apparatus of the invention, the intermediate roller brought into the upper surface of a stencil sheet is vertically movably provided in front of the platen roller, and therefore the intermediate roller is raised by the stencil sheet which is being conveyed while being tensed. Hence, the intermediate roller and the platen roller are automatically placed in parallel with each other, and the stencil sheet which is thermally cut with the thermal head and the platen roller is scarcely creased.

What is claimed is:

1. A stencil forming apparatus in which a stencil for a stencil printing is formed on a stencil sheet of a rolled stencil sheet, the stencil forming apparatus comprising:

a nip roller and a tension roller for nipping the stencil sheet pulled out from the rolled stencil sheet and for providing tension to the stencil sheet when the stencil sheet is pulled out through the nip roller and the tension roller;

a thermal head having a plurality of heat generating elements for thermally making fine holes on the stencil sheet;

a guide roller provided between said nip and tension rollers and the thermal head;

a platen roller having a central axis which is in parallel with said guide roller, and provided below said thermal head, said platen roller pulling the stencil sheet nipped by said nip and tension rollers, during stencil forming; and an intermediate roller having a shaft, said intermediate roller provided between said platen roller and said guide roller, wherein said intermediate roller is vertically movable by the stencil sheet in a predetermined range with respect to said guide roller and the platen roller when tension is applied to the stencil sheet during stencil forming, such that the shaft of said intermediate roller is raised and held in parallel with the central axis of said platen roller.

2. A stencil forming apparatus in which a stencil for a stencil printing is formed on a stencil sheet of a rolled stencil sheet, the stencil forming apparatus comprising:

a nip roller and a tension roller for nipping the stencil sheet pulled out from the rolled stencil sheet and for providing tension to the stencil sheet when the stencil sheet is pulled out through the nip roller and the tension roller;

a thermal head having a plurality of heat generating elements for thermally making fine holes on the stencil sheet;

a guide roller provided between said nip and tension rollers and the thermal head;

a platen roller having a central axis which is in parallel with said guide roller, and provided below said thermal head, said platen roller pulling the stencil sheet nipped by said nip and tension rollers, during stencil forming; and an intermediate roller having a shaft, said intermediate roller provided between said platen roller and said guide roller, wherein said intermediate roller is vertically movable by the stencil sheet in a predetermined range with respect to said guide roller and the platen roller when tension is applied to the stencil sheet during stencil forming, such that the shaft of said intermediate roller is raised and held in parallel with the central axis of said platen roller;

thermal head pawls attached to said thermal head, each having an elongated hole into which the shaft of said intermediate roller is slidably inserted.

3. The stencil forming apparatus according to claim 2, wherein the intermediate roller is supported by only the thermal head pawls.

4. A stencil forming apparatus in which a stencil for a stencil printing is formed on a stencil sheet of a rolled stencil sheet, the stencil forming apparatus comprising:

a nip roller and a tension roller for nipping the stencil sheet pulled out from the rolled stencil sheet and for providing tension to the stencil sheet when the stencil sheet is pulled out through the nip roller and the tension roller;

a thermal head having a plurality of heat generating elements for thermally making fine holes on the stencil sheet;

a guide roller provided between said nip and tension rollers and the thermal head;

a platen roller having a central axis which is in parallel with said guide roller, and provided below said thermal head, said platen roller pulling the stencil sheet nipped by said nip and tension rollers, during stencil forming; and an intermediate roller having a shaft, said intermediate roller provided between said platen roller and said guide roller, wherein said intermediate roller is vertically movable by the stencil sheet in a predetermined range with respect to said guide roller and the platen roller when tension is applied to the stencil sheet during stencil forming, such that the shaft of said intermediate roller is raised and held in parallel with the central axis of said platen roller;

thermal head pawls attached to said thermal head, each having a round hole into which the shaft of said intermediate roller is slidably inserted.

5. The stencil forming apparatus according to claim 4, wherein the intermediate roller is supported by only the thermal head pawls.

* * * * *